US011054232B2

(12) United States Patent
Novak et al.

(10) Patent No.: US 11,054,232 B2
(45) Date of Patent: Jul. 6, 2021

(54) FIREARM MAGAZINE HOLDER

(71) Applicant: Sportco, Inc., Holbrook, NY (US)

(72) Inventors: Robert Arthur Novak, Holbrook, NY (US); Steve Frank Carvajal, III, Chandler, AZ (US)

(73) Assignee: SPORTCO, INC., Holbrook, NY (US)

( * ) Notice: Subject to any disclaimer, the term of this patent is extended or adjusted under 35 U.S.C. 154(b) by 0 days.

(21) Appl. No.: 16/740,741

(22) Filed: Jan. 13, 2020

(65) Prior Publication Data

US 2020/0232774 A1 Jul. 23, 2020

Related U.S. Application Data

(60) Provisional application No. 62/793,980, filed on Jan. 18, 2019.

(51) Int. Cl.
*F42B 39/02* (2006.01)

(52) U.S. Cl.
CPC ..... *F42B 39/02* (2013.01)

(58) Field of Classification Search
CPC ..... F41B 39/02; F41B 39/08; F41C 33/02
See application file for complete search history.

(56) References Cited

U.S. PATENT DOCUMENTS

| | | | | |
|---|---|---|---|---|
| 2,910,804 | A * | 11/1959 | White | F41C 33/041 446/28 |
| 5,971,379 | A * | 10/1999 | Leon, Jr. | B25B 11/002 228/212 |
| 9,072,361 | B1 * | 7/2015 | Aravena | F41C 33/006 |
| 9,746,299 | B1 * | 8/2017 | Davis | F42B 39/02 |
| 10,118,277 | B2 * | 11/2018 | Wong | B25B 11/002 |
| 2013/0254976 | A1 * | 10/2013 | Aravena | F42B 39/02 2/300 |
| 2013/0270311 | A1 * | 10/2013 | Sitz | F41A 23/18 224/255 |
| 2018/0010871 | A1 * | 1/2018 | Bressler | F41A 9/24 |
| 2018/0238671 | A1 * | 8/2018 | Purkiss | F42B 39/02 |

* cited by examiner

*Primary Examiner* — Corey N Skurdal
(74) *Attorney, Agent, or Firm* — Abelman, Frayne, & Schwab

(57) ABSTRACT

A firearm magazine holder that includes an L-shaped bracket that magnetically attracts holds two adjoining walls of a steel box magazine.

10 Claims, 2 Drawing Sheets

FIREARM MAGAZINE HOLDER

FIELD OF THE INVENTION

This invention relates to weapon accessories and more particularly to a firearm magazine holder, a magnetized bracket to securely hold a large-capacity magazine for a pistol, rifle, or carbine.

BACKGROUND OF THE INVENTION

Firearms have been produced with a variety of different designs for storage of ammunition. One popular design incorporates the storage of rounds of ammunition in removable magazines that fit within an aperture of the firearm receiver. The use of such removable magazines provides certain advantages, such as rapidly loading and unloading the firearm with a magazine that may contain a number of rounds of ammunition. Another advantage is allowing a user to carry one or more extra magazines that are also loaded with additional rounds of ammunition.

A magazine is a box with an approximately rectilinear shape that fits through an aperture of the firearm receiver and into the firearm's internal magazine well that has a similar shape and size to that of the magazine. Such magazines can themselves be stored in a number of different places, such as in a shooter's pocket, or within a pouch that is typically attached to a belt that the shooter wears around his waist. When a firearm user is not certain that he will need to rely upon a spare magazine, such a solution may be adequate. However, there are organized competitive events, in which a shooter is challenged to shoot accurately and quickly, including having to exchange magazines one or more times to fire additional rounds. In such a competition, the delay associated with removing one or more spare magazines from a pocket or from a pouch is undesirable. For example, some competitions include as many as eight "standing reloads," in which a competitor must reload his pistol eight times during a timed competition. If a competitor can save even half a second per reload by using an improved magazine holder, that would add up to a four second reduction in the shooter's total time in the competition, a significant time savings.

Some designs utilize one or more magnets to hold a steel-sided firearm magazine by making contact with a single face of the box magazine. However, there are concerns over whether these earlier magnetic designs can rotationally stabilize firearm magazines, and, additionally, can securely hold the heavy high-capacity pistol magazines used in competitions.

What is needed is an improved firearm magazine holder that allows for a user to more securely carry a loaded firearm magazine on his body.

SUMMARY OF THE INVENTION

The present invention provides a substantial improvement in the design of a pistol, rifle, or carbine magazine holder for use in competitive shooting events. It incorporates an L-shaped bracket with magnets placed on the inner walls, to make contact with two of the four walls of a steel firearm box magazine.

The firearm magazine holder configured and arranged as described will provide improved functionality.

BRIEF DESCRIPTION OF THE DRAWINGS

Preferred embodiments of the invention are described herein below with reference to the drawings wherein.

DETAILED DESCRIPTION OF THE INVENTION

The present invention is directed towards a firearm magazine holder for use in securely holding a loaded pistol box magazine.

Figure 1:
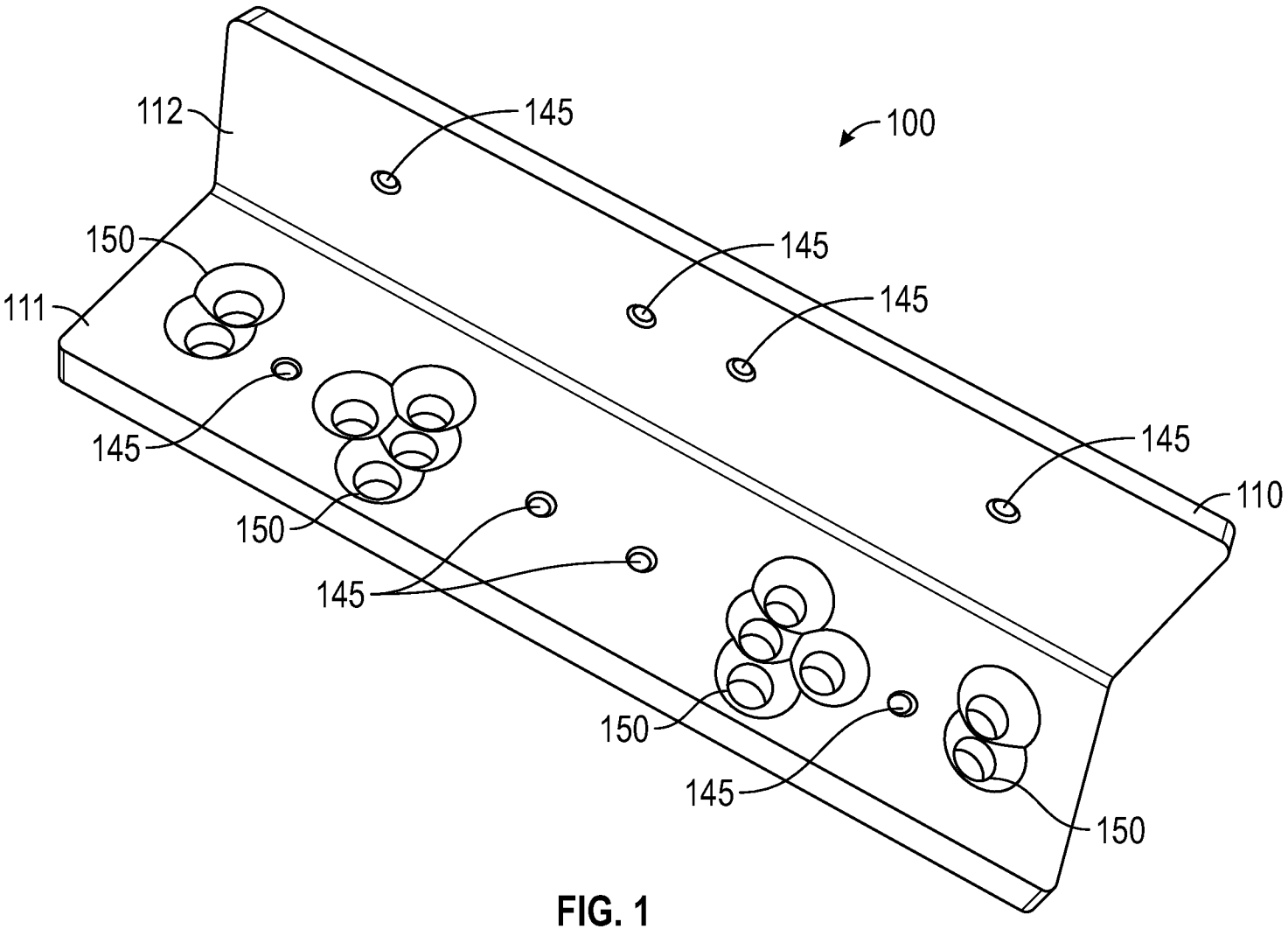
FIG. 1 shows the firearm magazine holder without the magnets.
Figure 2:
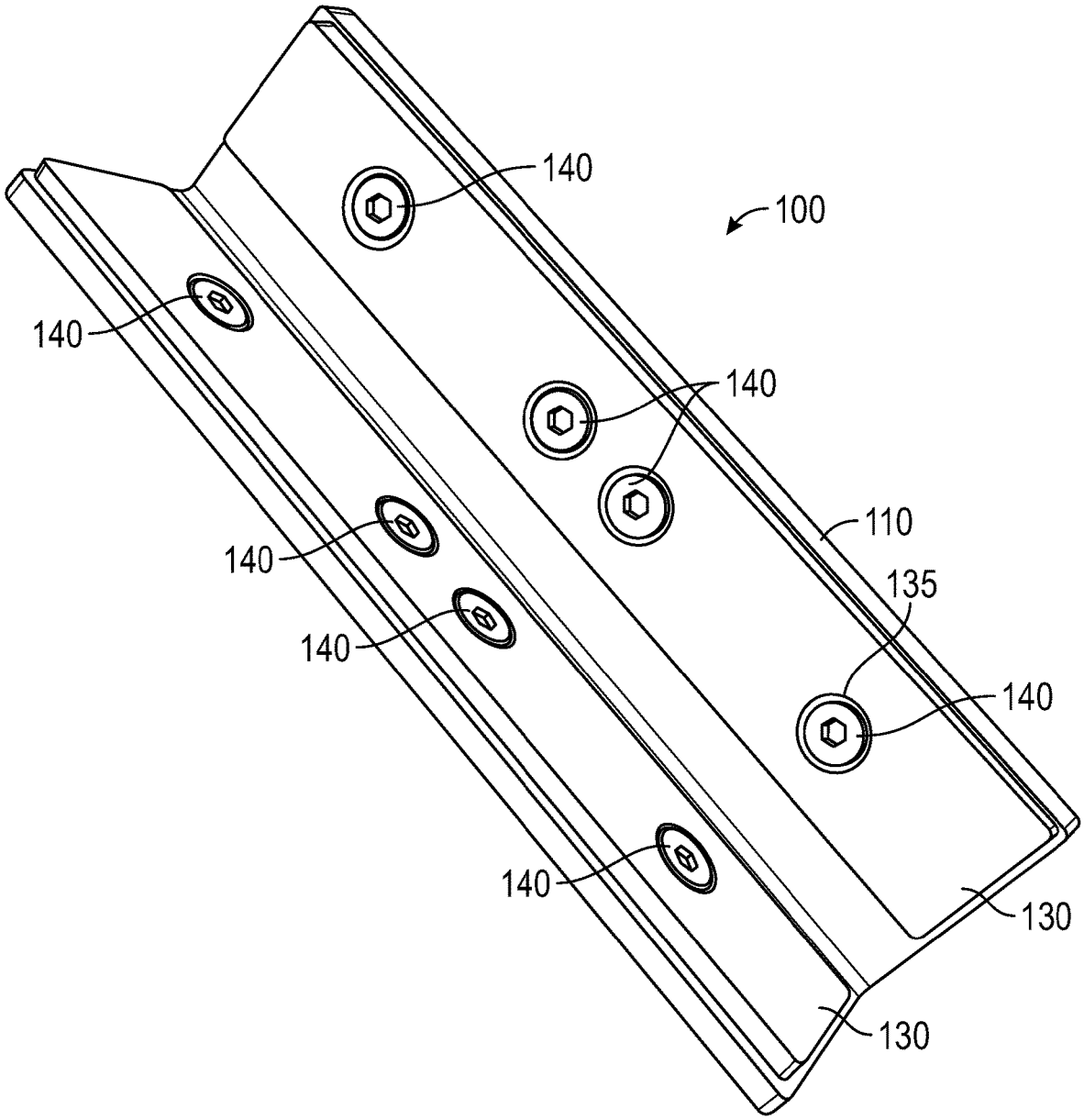
FIG. 2 shows the firearm magazine holder with the magnets in place.

FIGS. 1 and 2 show the firearm magazine holder 100, which comprises an L-shaped bracket 110. The two interior walls 111, 112 of L-shaped bracket 110 are provided with tapped holes 145 for receiving a fastener. Interior wall 111 is also provided with penetrations 150 for attaching the firearm magazine holder 100 to a third-party belt mount or to a third-party magazine pouch.

L-shaped bracket 110 is preferably made out of a metal, such as steel or aluminum, but could alternatively be made from a thermoplastic such as polyoxymethylene, or from a resinous fiber.

Attached to the two interior walls 111, 112 of L-shaped bracket 110 are magnets 130 covering a majority of the surface area of the two interior walls 111, 112. Magnets 130 include holes 135. In a preferred embodiment, magnets 130 are attached to the interior walls 111, 112 of L-shaped bracket 110 with fasteners 140, such as screws, that penetrate through holes 135 of magnets 130 and that screw into the tapped holes 145 provided interior walls 111, 112.

Interior wall 111 is also provided with penetrations 150 for attaching the firearm magazine holder 100 to a third-party belt mount or to a third-party magazine pouch. Penetrations 150 can be countersunk, as shown in FIGS. 1 and 2. Alternatively, penetrations 150 can be cylindrical instead of countersunk, in which case flathead screws would be used.

To attach firearm magazine holder 100 to a belt mount or magazine pouch, a user would first remove magnet 130 from interior wall 111. The user would then insert fasteners through penetrations 150 of wall 111 and into the selected belt mount or magazine pouch, securing L-shaped bracket 110 to the belt mount or magazine pouch. Magnet 130 could then be reinstalled onto interior wall 111 with fasteners 140, as explained above.

In one preferred embodiment, L-shaped bracket 110 is 4.89" long, wall 111 is 1.25" wide and 0.24" thick, and wall 112 is 1.385" wide and 0.126" thick.

In a second preferred embodiment, L-shaped bracket 110 is 2.45" long, wall 111 is 1.25" wide and 0.24" thick, and wall 112 is 1.385" wide and 0.126" thick.

Magnets 130 should be strong enough to hold a loaded steel box magazine to L-shaped bracket 110, without being so strong that they create a pinch-hazard for users or make it too difficult to remove a magazine from L-shaped bracket 110. In a preferred embodiment, magnets 130 are made from an alloy of rare-earth elements. In a preferred embodiment, magnets 130 are made from an alloy of molybdenum.

While preferred embodiments of the present invention have been illustrated and described herein, it will be apparent that such embodiments are provided by way of example only. Numerous variations, changes and substitutions will be apparent to those skilled in the art without departing from the invention, the scope of which is to be determined by the following claims.

The invention claimed is:

1. A firearm magazine holder to magnetically hold a steel box magazine, the firearm magazine holder comprising:

a bracket with a first wall and a second wall with internal surfaces fixed along an axis at a 90° angle with respect to each other, and external surfaces fixed along an axis at a 270° angle with respect to each other, wherein the first wall has a first width extending out from the axis, the first width being less than a length of the axis, wherein the second wall has a second width extending out from the axis, the second width being less than the length of the axis, wherein the first wall has a first thickness that is less than the first width, wherein the second wall a second thickness that is less than the second width, wherein the internal surfaces of the first wall and second wall have a majority of their surface areas covered with magnets to attract and hold the steel box magazine.

2. The firearm magazine holder of claim 1, wherein the internal side of the first wall includes penetrations facilitating mounting of the firearm magazine holder to a belt mount or to a magazine pouch.

3. The firearm magazine holder of claim 2, wherein the penetrations are countersunk.

4. The firearm magazine holder of claim 2, wherein the penetrations are cylindrical.

5. The firearm magazine holder of claim 2, wherein the magnets are attached to the internal surfaces of the first wall and second wall of the bracket by fasteners that pass through penetrations in the magnets and into tapped holes in the internal surfaces of the first wall and second wall.

6. The firearm magazine holder of claim 2, wherein the first thickness is thicker than the second thickness.

7. The firearm magazine holder of claim 1, wherein the magnets are attached to the internal surfaces of the first wall and second wall of the bracket by fasteners that pass through penetrations in the magnets and into tapped holes in the internal surfaces of the first wall and second wall.

8. The firearm magazine holder of claim 1, wherein the bracket is made of steel.

9. The firearm magazine holder of claim 1, wherein the bracket is made of aluminum.

10. The firearm magazine holder of claim 1, wherein the magnets are made of an alloy of molybdenum.

* * * * *